United States Patent [19]

Igarashi et al.

[11] 4,150,072

[45] Apr. 17, 1979

[54] CARBURETOR

[75] Inventors: Bunzi Igarashi; Hiroshi Miyamoto, both of Mito, Japan

[73] Assignee: Hitachi, Ltd., Japan

[21] Appl. No.: 858,806

[22] Filed: Dec. 8, 1977

[30] Foreign Application Priority Data

Dec. 10, 1976 [JP] Japan ..... 51-149207

[51] Int. Cl.[2] ..... F02M 7/02

[52] U.S. Cl. ..... 261/121 A

[58] Field of Search ..... 261/121 A, 121 B

[56] References Cited

U.S. PATENT DOCUMENTS

| | | | |
|---|---|---|---|
| 1,404,879 | 1/1922 | Mock | 261/121 A |
| 1,553,130 | 9/1925 | Baverey | 261/121 A |
| 1,748,472 | 2/1930 | Ensign | 261/41 D |
| 1,805,763 | 5/1931 | Ensign | 261/121 A |
| 1,889,126 | 11/1932 | Malin | 261/121 A |
| 1,916,062 | 6/1933 | Memini | 261/121 A |
| 2,621,030 | 12/1952 | Henning | 261/121 A |

FOREIGN PATENT DOCUMENTS

| | | | |
|---|---|---|---|
| 399644 | 12/1916 | Fed. Rep. of Germany | 261/121 A |
| 1291936 | 4/1969 | Fed. Rep. of Germany | 261/121 A |
| 693168 | 4/1930 | France | 261/121 A |

*Primary Examiner*—Tim R. Miles

*Attorney, Agent, or Firm*—Craig & Antonelli

[57] ABSTRACT

A carburetor including a suction conduit provided with a venturi, a fuel nozzle opening at one end in the venturi, a fuel passageway having a predetermined fuel level, the fuel nozzle opening at the other end in the fuel passageway, and an air fuel mixing tube inserted in the fuel passageway and formed with an air bleed and an air ejecting aperture or apertures, wherein the air ejecting aperture or the air ejecting apertures and the air bleed are located at a level higher than the fuel level in the fuel passageway and substantially on an extension of the axial center line of the fuel nozzle.

1 Claim, 11 Drawing Figures

CARBURETOR

BACKGROUND OF THE INVENTION

This invention relates to cerburetors for internal combustion engines, and more particularly to an improvement in a carburetor for use in a motor vehicle.

With the strengthening of measures taken in recent years for preventing enviromental distruption by noxious effluents released to atmosphere, there have been increasingly severe restrictions imposed by law on the amounts of noxious components of exhaust gases of motor vehicles. The cope with this situation, prescription has been designed in formulating requirements to be satisfied by internal combustion engines, particularly for use in motor vehicles, for the purpose of eliminating the problem of air pollution by the exhaust gases of motor vehicles. However, a difficulty has been experienced in meeting the conflicting demands to reduce air-polluting constituents of exhaust gases on one hand and to improve the performance of a motor vehicles and decrease the fuel consumption thereof on the other. As a means for satisfying these conditions, carburetors which have a great deal to do with the combustion of fuel in the engines have come to attract the attention of those concerned in the motor vehicle industry. More specifically research has in recent years been conducted in various countries on carburetors for effecting incresed vaporization of fuel and stabilization of a flow of mixture of atomized fuel particles and air from the carburetor to the engine.

Of all the types of carburetors now in use, a carburetor which have been most favored are of the type which uses what is referred to as an air fuel mixing tube which is a metal tube formed therein with many apertures and arranged in the fuel passage at a level lower than the fuel level in the fuel passage for ejecting air through the apertures in order to convert fuel into atomized particles. Various programs have been under way to conduct studies on the number and position of the air ejecting apertures so as to provide improvements in this type of carburetors. However, a flow of fuel to the engine still tends to become an intermittent flow at the time the engine is started or abruptly accelerated and the fuel begins to gush out, and the particles of fuel are still large in size. As a result, the air-polluting constituents of exhaust gases are still large in amounts.

SUMMARY OF THE INVENTION

Accordingly this invention has as its object the provision of a carburetor which is capable of causing fuel of flow in a uniform stream through a fuel nozzel so as to reduce the amounts of air-polluting constituents of the exhaust gases of a motor vehicle, reducing fuel consumption and improving the performance of the motor vehicle.

The outstanding characteristic of the invention is that an air ejecting aperture formed in an air fuel mixing tube is disposed at a level higher than the fuel level in a fuel passageway in which the air fuel mixing tube is mounted and located substantially on an extension of the axial center line of a fuel nozzle. Not only the air ejecting aperture but also air ejecting apertures and an air bleed may be located in the aforementioned position.

Figure 3:
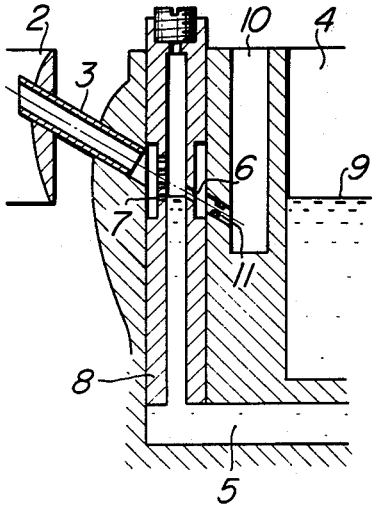

FIGS. *2a*, *2b* and *2c* are sectional views of the fuel nozzle, FIG. *2a* showing a slug flow of fuel in the fuel nozzle, FIG. *2b* showing a slightly improved slug flow therein and FIG. *2c* showing an ideal annular flow therein;

FIG. 3 is a fragmentary sectional front view of the carburetor comprising another embodiment of the invention; and FIG. 4 shows graphs representing variations in the amounts of hydrocarbons in engine exhaust gases.

DETAILED DESCRIPTION OF THE EMBODIMENTS

Figure 1:
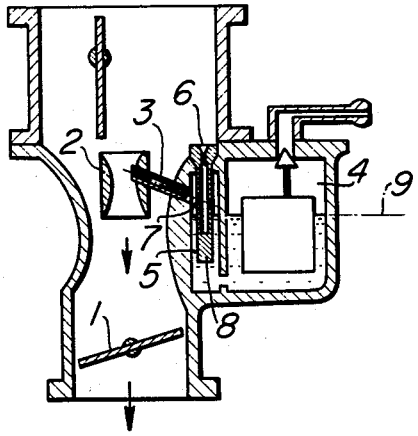
FIG. 1 is a sectional front view of the carburetor comprising one embodiment of the invention.

FIG. 1 is a sectional front view of one embodiment of carburetor in conformity with the present invention. As shown, the carburetor comprises a suction conduit having a throttle valve 1 mounted therein. A venturi 2 is located in the suction conduit in a position nearer to an air inlet than the throttle valve 1, and a fuel nozzle 3 opens at one end in the venturi 2. The fuel nozzle 3 extends through the wall of the suction conduit and opens at the other end in a space above a fuel level 9 in a fuel passageway 5. The air entering through an air bleed 6 into an air fuel mixing tube 8 is ejected through an air ejecting aperture 7 into the fuel passageway 5. Fuel is supplied to a float chamber 4 through a tube disposed thereabove so as to keep the fuel level 9 constant at all times.

The carburetor of the aforesaid construction operates as follows. Upon the throttle valve 1 being opened following starting of the engine, air flows in a direction indicated by arrows and is supplied to the engine. At this time, the air flowing through the venturi 2 disposed in the center of the suction conduit has a high flow rate, with a result that a relatively high negative or subatmospheric pressure is produced in the venturi 2. This causes the fuel level 9 in the fuel passageway 5 to rise, and at the same time the air entering through the air bleed 6 into the air mixing tube 8 is ejected through the air ejecting aperture 7 into the fuel passageway 5 to convert the fuel into atomized particles. The air entrained with the atomized particles of fuel is released through the fuel nozzle 3 into the venturi 2 and supplied to the engine.

In order to compare the carburetor according to the invention with a carburetor of the prior art, a fuel flow in the fuel nozzle 3 will be explained.

Figure 2A:
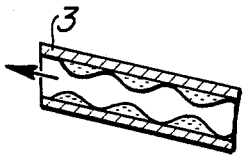
Figure 2B:
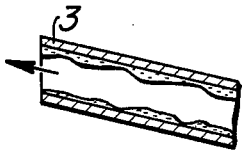
Figure 2C:
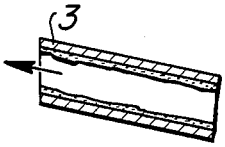

FIG. 2 shows the fuel nozzle 3 in sectional views, in explanation of various types of fuel flows through the fuel nozzle 3. In FIG. *2a*, the fuel is shown as flowing in what is commonly referred to as a slug flow. The fuel converted into atomized particles within the air fuel mixing tube 8 in accompanied by air when passing through the fuel nozzle 3. When the fuel has a highly density and its density undergoes a change intermittently, then the fuel adheres to the inner wall surface of the fuel nozzle 3 and flows in a striped pattern having elevated and depressed areas. The fuel supplied through the fuel nozzle 3 at this time is gross in particles, and the fuel supplied to the engine various in density from time to time. If this slug flow in enchanced in intensity, the fuel flows through the fuel nozzle 3 in what is referred to as a piston flow, in which the fuel in the state of a liquid and air bubbles pass in turn through the fuel nozzle 3. FIG. *2b* shows a fuel flow which represents some improvement in the slug flow. It will be seen that although there are still elevated and depressed areas, a substantially continuous fuel layer passes through the fuel nozzle 3. FIG. 2c shows an ideal form of fuel flow, with the fuel continuously flowing through the fuel nozzle 3 in a thin film of uniform thickness formed on the inner wall surface of the fuel nozzle 3.

In the carburetor of the prior art, the liquid column in the fuel passageway 5 is subjected to vibrations due to the ejection of air bubbles thereinto a variations in the fuel level itself, because the air ejecting aperture or apertures are disposed at a level below the fuel level. Also, since the air ejecting aperture is not located on an extension of the axial center line of the fuel nozzle 3, an air current does not flow smoothly, with a result that a flow of air bubbles becomes markedly intermittent due to the surface tension of the fuel. Thus there are large variations in the density of the fuel passing through the fuel nozzle 3. This phenomenon is reflected in fuel flows illustrated in FIGS. 2a and 2b.

In the carburetor according to the invention, streams of air and fuel are little affected by the surface tension of the fuel and variations in the fuel level, because the air ejecting apertures is located substantially on an extension of the axial center line of the fuel nozzle 3. Thus, the fuel flows through the fuel nozzle 3 in a stream as illustrated in FIG. 2c, and the fuel that has passed through the fuel nozzle 3 is converted into atomized particles at the outlet of the fuel nozzle 3 by an air current passing through the venturi 2, so that a fuel-air mixture of uniform density is supplied to the engine. By this arrangement, the fuel burns in complete combustion and the air-polluting constituents of the exhaust gases are very small in amounts.

As aforesaid, in accordance with the present invention, the air ejecting aperture 7 is disposed at a level higher than the fuel level 9 and located substantially on an extension of the axial center line of the fuel nozzle 3. There is no air ejecting aperture 7 in a portion of the air fuel mixing tube 8 which is disposed below the fuel level 9. Thus when a subatmospheric pressure is produced in the fuel nozzle 3, the fuel level 9 in and out the air fuel mixing tube 8 rises and gets near the air ejecting aperture 7 and the fuel flows through the air ejecting aperture 7 into the fuel nozzle 3 due to the action of the air stream. At this time, the air is never ejected in the form of intermittent flow of bubbles separated from the fuel, but converts the fuel into a jet of mist in accordance with the principles of an atomizer, thereby converting the fuel into atomized particles. Moreover, since the stream of a fuel-air mixture passing through the fuel nozzle 3 flows substantially along its axial center line, there is little chance of the stream of a fuel-air mixture impinging on the wall of the nozzle 3 and forming a fuel film theron. Even if the fuel film is formed, the fuel stream is in the condition as shown in FIG. 2c, so that it is possible to supply to the engine a fuel in the form of uniformly atomized particles.

In accordance with this embodiment of carburetor in conformity with the invention, it is possible to supply to the engine a fuel in the form of miniscule particles at all times, thereby offering the advantages of satisfactorily controlling exhaust emissions and reducing fuel consumption.

FIG. 3 is a sectional front view of the fuel nozzle and the air fuel mixing tube of another embodiment of carburetor in conformity with the invention. The air fuel mixing tube 8 which is inserted and embedded in the main body of the carburetor opens at its lower end in the fuel passageway 5 and closed at its upper end by a screw. The air fuel mixing tube 8 is cut off in its intermediate portion to provide diametrically opposed recesses disposed in parallel vertical planes, and a plurality of air ejecting apertures 7 and the air blead 6 are formed in these recesses in a manner to be located substantially on an extension of the fuel nozzle 3. The air ejecting apertures 7 and the air bleed 6 are located at a level higher than the fuel level 9. Air is introduced into an air inlet hole 10 and passes through a throttle 11 formed in the wall of the hole 10 to be drawn into the air bleed 6 formed in the recesses wall portion of the air fuel mixing tube 8. Since the throttle 11 is also located substantially on an extension of the axial center line of the fuel nozzle 3, the air introduced into the air inlet hole 10 is formed into a streamlined air stream, thereby contributing to atomization of the fuel. When a subatmospheric pressure is produced in the fuel nozzle 3, air is introduced into the air fuel mixing tube 8 through the air bleed 6 and converts the fuel into atomized particles of uniform size which air is supplied to the engine. The arrangement that the air fuel mixing tube 8 is embedded in the carburetor main body in this embodiment offers an advantage in that the stream of a fuel-air mixture containing fuel in atomized particles is not disturbed by the fuel whose level rises at the outside of the air fuel mixing tube 8. The air fuel mixing tube 8 is shown in FIG. 3 as being closed by a screw. It is to be understood that it is not essential to close the upper end by a screw and that the upper end of the tube 8 may be left open.

As aforesaid, the embodiment shown in FIG. 3 offers the advantage of a fuel-air mixture containing fuel in uniformly atomized particles being supplied to the engine without its flow being obstructed by the fuel level at the outside of the air fuel mixing tube 8.

EXAMPLES

FIG. 4 shows graphs representing variations in the amounts of non-combusted hydrocarbons (hereinafter referred to as HC contents), in terms of the hexane contents, in the exhaust gases of engines. The HC contents are set forth along the vertical axis, and time is set forth along the horizontal axis. FIGS. 4a and 4b show the results of tests conducted with a carburetor of the prior art in which the air ejecting aperture is disposed below the fuel level. FIGS. 4c and 4d show the results of tests conducted with the carburetor shown in FIG. 1 in which the air ejecting aperture is located substantially on an extension of the axial center line of the fuel nozzle. FIGS. 4e and 4f show the results of tests conducted with the carburetor shown in FIG. 3 in which both the air ejecting apertures and the air bleed are located substantially on an extension of the axial center line of the fuel nozzle. All the experiments were conducted by using the same 1.6 liter, 4-cylinder, 4-cycle engine and under the same conditions of the engine speed being 2000 rpm and the suction subatmospheric pressure being −300 mmHg.

Figure 4A:
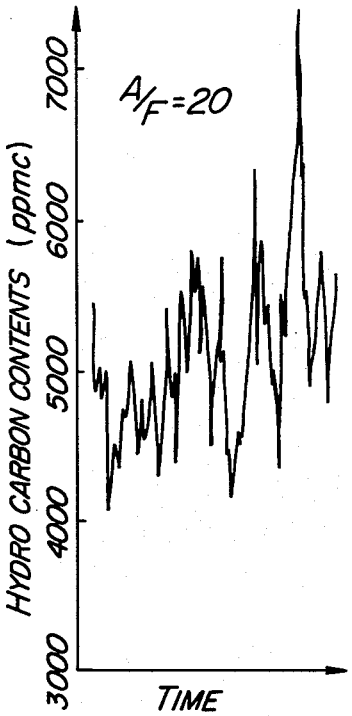
Figure 4C:
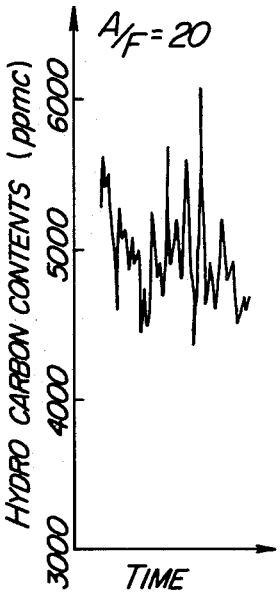
Figure 4E:
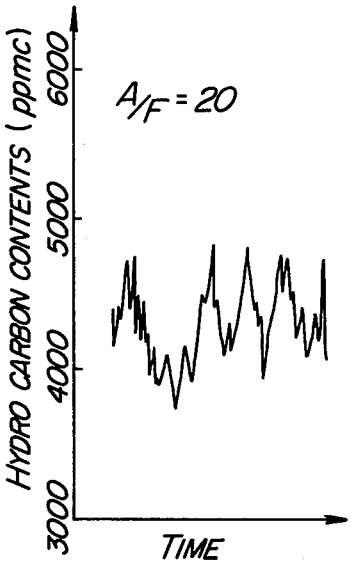
Figure 4B:
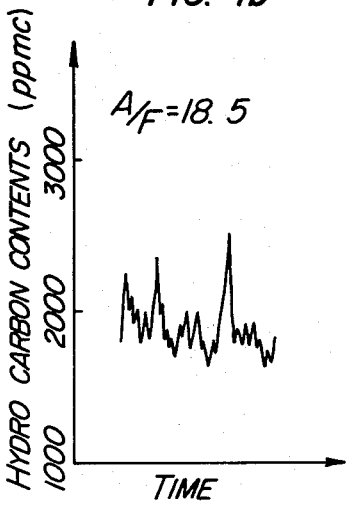

FIGS. 4a and 4b show variations of HC contents which occurred when a carburetor of the prior art in which the air ejecting aperture is disposed below the fuel level was used. FIG. 4a shows the result obtained when the ratio of the quantity of air to that of fuel (hereinafter referred to as an air-fuel ratio) was 20, while FIG. 4b shows the result obtained when the air-fuel ratio was 18.5. It will be seen from the graphs that the HC contents show large fluctuations, indicating that combustion of the fuel in the engine is not taking place satisfactorily. The incomplete combustion of the fuel can be attributed to great variations in the density of the fuel in the fuel-air mixture supplied to the engine as described previously.

Figure 4D:
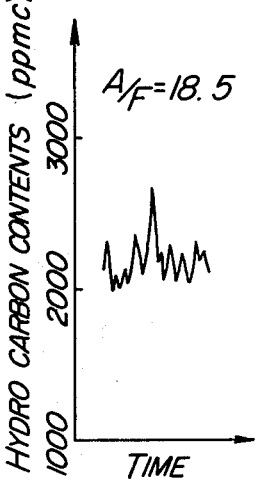

FIG. 4c shows the result obtained when the air-fuel ratio was 20, while FIG. 4d shows the result obtained when the air-fuel ratio was 18.5. The carburetor used in these experiments which is shown in FIG. 1 is such that the air mixing tube 8 is closed at its lower end and the fuel nozzle 3 is embedded in the wall of the suction conduit. However, whether or not the lower end of the air fuel mixing tube is open or the fuel nozzle is embedded in the wall causes no essential differences in the effects achieved by the present invention. What is important is that the air ejecting aperture 7 is disposed above the fuel level 9 and located substantially on an extension of the axial center line of the fuel nozzle 3. It will be seen in FIGS. 4c and 4d that the fluctuations in the HC contents are smaller than in a conventional carburetor, indicating that variations in the density of fuel in the fuel-air mixture supplied to the engine are small.

Figure 4F:
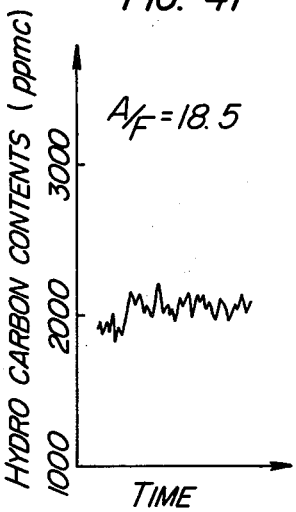

FIG. 4e shows the result obtained when the air-fuel ratio was 20, while FIG. 4f shows the result obtained when the air-fuel ratio was 18.5. In the carburetor used in these experiments, a plurality of air ejecting apertures 7 and the air bleed 6 are located substantially on an extension of the axial center line of the fuel nozzle 3, and they are both disposed above the fuel level. It will be seen that if the aforementioned conditions are satisfied, the variations in the HC contents are similar to those produced in the embodiment of carburetor shown in FIG. 1, although there are slight changes in the shape of the waves. It should be noted that in the embodiment shown in FIG. 3, the variations in the HC contents are particularly small when the air-fuel ratio is 18.5, indicating that the carburetor has the effect of causing the fuel to burn satisfactorily.

From the foregoing description, it will be appreciated that the carburetor in accordance with this invention can achieve the marked results of rendering uniform a stream of fuel flowing in the fuel nozzle, improving the manner of combustion of the fuel in the engine to reduce the amounts of air-polluting constituents of exhaust gases, reducing the fuel comsumption and improving the performance of the engine.

What is claimed is:

1. In a carburetor comprising:

a suction conduit;

a venturi disposed in said suction conduit;

a tubular fuel nozzle opening at one end thereof in said venturi;

a fuel passageway having a predetermined fuel level, said fuel nozzle opening at the other end thereof in said fuel passageway;

an air fuel mixing tube formed with an air bleed and a plurality of air ejecting apertures and inserted in said fuel passageway;

fuel in said fuel passageway being supplied, upon a subatmospheric pressure being produced in said venturi, along with air introduced into said air fuel mixing tube through said air bleed, to said suction conduit through said air ejecting apertures and said fuel nozzle;

an improvement wherein said air ejecting apertures and said air bleed are disposed above said fuel level and located substantially on an extension of the axial center line of said fuel nozzle.

* * * * *